US006995779B1

(12) United States Patent
Tanaka

(10) Patent No.: US 6,995,779 B1
(45) Date of Patent: Feb. 7, 2006

(54) DRIVING DEVICE FOR A DISPLAY

(75) Inventor: Toshimasa Tanaka, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/238,423

(22) Filed: Jan. 28, 1999

(30) Foreign Application Priority Data

Jan. 29, 1998 (JP) ..... 10-017183
Jan. 29, 1998 (JP) ..... 10-017185

(51) Int. Cl.
*G09G 5/22* (2006.01)

(52) U.S. Cl. ..... 345/636; 345/551; 345/87

(58) Field of Classification Search ..... 345/141, 345/143, 144, 133, 123, 147, 148, 87, 636, 345/531, 536, 551, 88, 89, 38, 55, 100
See application file for complete search history.

(56) References Cited

U.S. PATENT DOCUMENTS 4,388,621 A * 6/1983 Komatsu et al. ..... 345/213
4,404,552 A * 9/1983 Hirahata et al. ..... 345/116
4,737,927 A * 4/1988 Hanabusa et al. ..... 701/200
4,951,226 A * 8/1990 Sasaki ..... 345/141
5,729,247 A * 3/1998 Shibasaki ..... 345/113

* cited by examiner

*Primary Examiner*—Xiao Wu
(74) *Attorney, Agent, or Firm*—Arent, Fox, PLLC.

(57) ABSTRACT

A driving device drives a liquid crystal display device or the like to achieve screen display. This driving device has a driver integrated circuit device for feeding a driving signal to a display, a read-only memory having characters stored therein, and a microcomputer for feeding the driver integrated circuit device with bit-mapped data used to achieve graphic display and address data used to specify characters. The driver integrated circuit device, on receiving bit-mapped data, produces a driving signal in accordance with the received bit-mapped data, and, on receiving address data, reads the characters corresponding to the received address data from the read-only memory and produces a driving signal for character-based display.

19 Claims, 9 Drawing Sheets

DRIVING DEVICE FOR A DISPLAY

BACKGROUND OF THE INVENTION

1. Field of the Invention

The present invention relates to a driving device that is used to drive a display such as a liquid crystal display.

2. Description of the Prior Art

First, a conventional driving device designed to drive a display will be described with reference to FIG. 11. FIG. 11 is a block diagram of a display apparatus that achieves screen display on a display 60 that is controlled by a microcomputer 62 through a driver IC (integrated circuit) 61.

This display apparatus also has a character ROM (read-only memory) 63 in which characters such as letters and symbols to be displayed are stored. The microcomputer 62 reads from the character ROM 63 the data of the characters it is going to display, and stores the obtained character data in a RAM (random-access memory) provided within the microcomputer 62. The microcomputer 62 then outputs this character data, as bit-mapped display data, to the driver IC 61. The driver IC 61 then produces a driving signal in accordance with this display data, and feeds the produced driving signal to the display 60 to display the desired characters thereon.

Accordingly, to display characters on the display 60, the microcomputer 62 needs to access first the character ROM 63, to read the corresponding data therefrom, and then the driver IC 61. As a result, in this display apparatus employing a conventional driver IC 61, the microcomputer 62, which needs to access the driver IC 61 as frequently as it needs to access the character ROM 63, is required to operate at an accordingly high rate, and thus tends to suffer from unduly high electric current consumption.

Moreover, with the development of larger and larger display systems, the size of the display 60 as well as the number of characters stored in the character ROM 63 tends to increase. This leads not only to an increase in the number of addresses used to specify characters, but also to an increase in the number of characters that are displayed on the display 60 at a time. As a result, the microcomputer 62 needs to read more character data from the character ROM 63, and thus it needs to access the character ROM 63 more frequently; on the other hand, the microcomputer 62 outputs more display data, and thus it needs to access the driver IC 61 more frequently. In this way, with the development of larger and larger display systems, the microcomputer 62, which needs to access both the driver IC 61 and the character ROM 63 more frequently, is required to operate at an even higher rate, and thus suffers from even higher electric current consumption.

Moreover, in the above-described display apparatus, to achieve refreshing, such as scrolling, of what is displayed on the screen, the microcomputer 62 first needs to access the character ROM 63 to read therefrom the display data of the characters to be scrolled and store the obtained data in the above-mentioned RAM in a way that corresponds to the state of the screen after the scrolling; then, the microcomputer 62 needs to output the bit-mapped data for the entire screen to the driver IC 61. In this way, to achieve the scrolling of the characters read from the character ROM 63, the microcomputer 62 needs to access the character ROM 63 still more frequently, and is thus required to operate at a still higher rate.

SUMMARY OF THE INVENTION

An object of the present invention is to provide a driving device for a display in which a control device such as a microcomputer is allowed to access a character ROM and a driver IC less frequently so that a reduction is achieved in the electric current consumed by the control device.

Another object of the present invention is to provide a driving device for a display in which a control device such as a microcomputer is allowed to access other devices less frequently during refreshing, such as scrolling, of what is displayed on the screen.

To achieve the above objects, according to one aspect of the present invention, a driving device for a display is provided with: a driver for forming a signal with which to drive a display in accordance with display data; a ROM having character data stored therein; reading means for reading character data from the ROM; designating means for producing a designating signal by which each of the display areas obtained by dividing the display screen of the display is designated as either a character-based display area or a graphic display area; input means for accepting input of graphic data and address data; a RAM for storing the graphic data; separating means for feeding, in accordance with the designating signal, the address data to the reading means for the display areas designated as character-based display areas and the graphic data to the RAM for the display areas designated as graphic display areas; and a selector for feeding either the character data from the reading means or the graphic data from the RAM to each of the display areas in accordance with whether the display area is designated as a character-based display area or a graphic display area.

According to another aspect of the present invention, a driving device for a display is provided with: a driver integrated circuit device for feeding a driving signal to a display; a read-only memory having characters stored therein; and a microcomputer for feeding the driver integrated circuit device with bit-mapped data used to achieve graphic display and address data used to specify characters. Here, the driver integrated circuit device, on receiving bit-mapped data, produces a driving signal in accordance with the received bit-mapped data, and, on receiving address data, reads the characters corresponding to the received address data from the read-only memory and produces a driving signal for character-based display.

According to still another aspect of the present invention, a driving device for a display is provided with: a data memory for storing input data that includes bit-mapped data and address data used to read externally provided characters; a driver circuit for producing a drive signal with which to drive a display in accordance with the input data; a control signal feeding circuit for feeding a control signal; a character memory for storing characters; a reading circuit for reading the data corresponding to the characters to be displayed in accordance with the address data and feeding the data thus read to a display control circuit; and a display control circuit for achieving a change, in accordance with the control signal, in what is displayed on the display by performing predetermined processing on the data that is fed to the driver circuit. Here, the predetermined processing is performed, for example, to achieve scrolling, blinking, or reversing of the image color and the background color in what is displayed on the display.

BRIEF DESCRIPTION OF THE DRAWINGS

This and other objects and features of the present invention will become clear from the following description, taken in conjunction with the preferred embodiments with reference to the accompanied drawings in which.

DESCRIPTION OF THE PREFERRED EMBODIMENTS

First Embodiment

Figure 1:
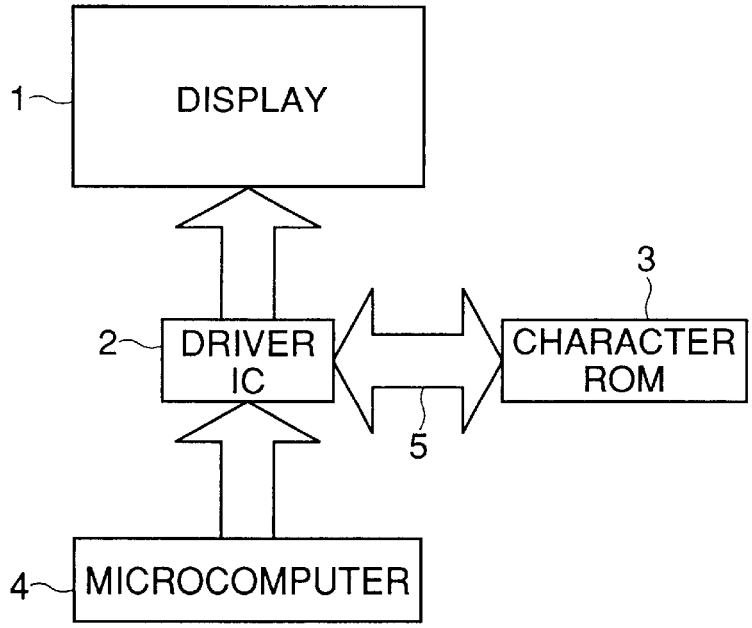
FIG. 1 is a block diagram of a driving device for a display of a first embodiment of the invention.

Hereinafter, embodiments of the present invention will be described with reference to the accompanying drawings. FIG. 1 shows a block diagram of a first embodiment of the invention. Here, a display apparatus is composed of a display 1 on which screen display is achieved, a driver IC 2 for feeding a driving signal to the display 1, a character ROM having characters such as symbols and letters stored therein, and a microcomputer 4 for controlling the screen display. The driver IC 2 and the character ROM 3 communicate with each other by way of a bus 5.

The microcomputer 4 controls the display 1 by feeding the driver IC 2 with both bit-mapped data that is used as display data to achieve graphic display and address data that is used to specify characters such as symbols and letters to be displayed. As will be described in detail later, on receiving bit-mapped data, the driver IC 2 stores the received bit-mapped data in a display data RAM 12 (see FIG. 4) provided within the driver IC 2 and produces a driving signal in accordance with the stored bit-mapped data. On the other hand, on receiving address data, the driver IC 2 accesses the character ROM 3 to read therefrom the character data stored in the area specified by the received address data, and then displays the corresponding characters on the display 1.

Figure 2:
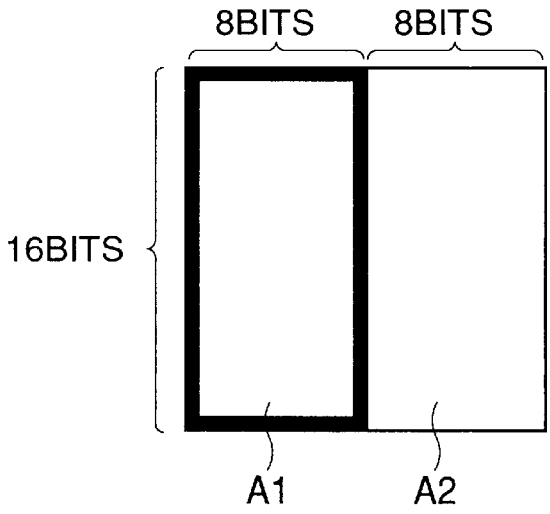
FIG. 2 is a diagram illustrating an example of the configuration of the area allotted to each character within the character ROM used in the first embodiment.

As shown in FIG. 2, the character ROM 3 stores, for example, Chinese/Japanese characters (two-byte) in the form of 16—16-bit data each. The areas A1 and A2 occupied by the data for one Chinese/Japanese character correspond to two addresses, meaning that each of the areas A1 and A2 is specified by one set of address data fed from the microcomputer 4 to the driver IC 2.

Accordingly, in a case where the microcomputer 4 operates on an 8-bit basis and the address data for each of the areas A1 and A2 consists of 16 bits, displaying one Chinese/Japanese character on the screen of the display 1 requires the microcomputer 4 to access the driver IC 2 four times to output two sets of address data 8 bits at a time.

Figure 11:
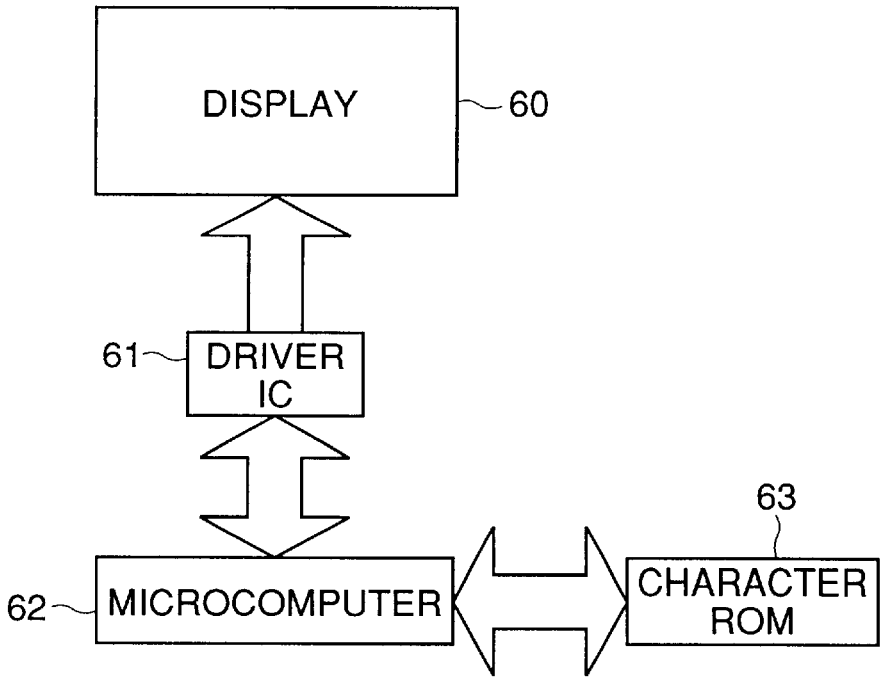
FIG. 11 PRIOR ART
FIG. 11 is a block diagram of a conventional driving device for a display.

By contrast, in the conventional display apparatus (FIG. 11) described earlier, under the same conditions as described above, if it is assumed that the microcomputer 62 is operating on an 8-bit basis, simply reading the data for one character from the character ROM 63 requires the microcomputer 62 to access the character ROM 63 thirty-two times (32 times) because the data consists of 16×16 bits, and, in addition, outputting the data to the driver IC 61 requires the microcomputer 62 to access the driver IC 61 another 32 times. Thus, the microcomputer 62 needs to perform an access operation as many as 64 times in total. By contrast, in the embodiment under discussion, the microcomputer 4 does not need to read character data directly from the character ROM 3, and thus has only to perform an access operation less frequently.

The bus 5 through which the driver IC 2 and the character ROM 3 communicate with each other is composed of an address bus of a parallel 18-bit type, a data bus of a parallel 8-bit type, and a read-enable signal bus used to indicate whether data is currently ready to be read or not. The reason that an address bus of an 18-bit type is used here is that the character ROM 3 has a storage capacity of 2 megabits that is addressed by the use of 8-bit addresses. The address bus may be, instead of being of a parallel 18-bit type, of a two-line serial 9-bit type.

Figure 3:
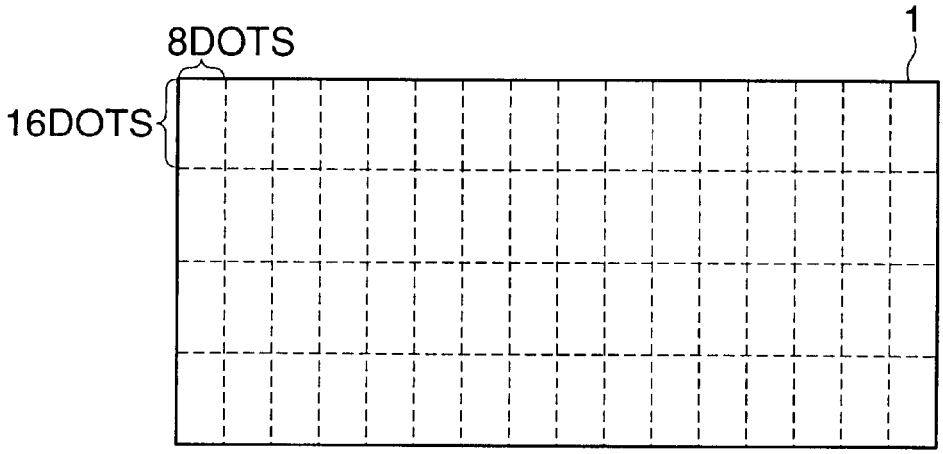
FIG. 3 is a diagram illustrating the areas obtained by dividing the display screen in a lattice-like pattern in the first embodiment.

In this embodiment, to achieve both graphic and character-based display, as shown in FIG. 3, the screen of the display 1 is divided vertically into four rows and horizontally into 16 columns, i.e. into a total of 64 areas arranged in a lattice-like pattern. Each of these areas consists of vertically 16×horizontally 8 dots, and whether each area is used for graphic display or for character-based display is designated by a designating signal that is fed from the microcomputer 4 to the driver IC 2.

The driver IC 2 assigns an address to each area, and stores the designating signal address by address in an area memory (not shown) provided within itself. For example, the designating signal is equal to 0 (zero) when designating a graphic display area and equal to 1 (one) when designating a character-based display area.

Figure 4:
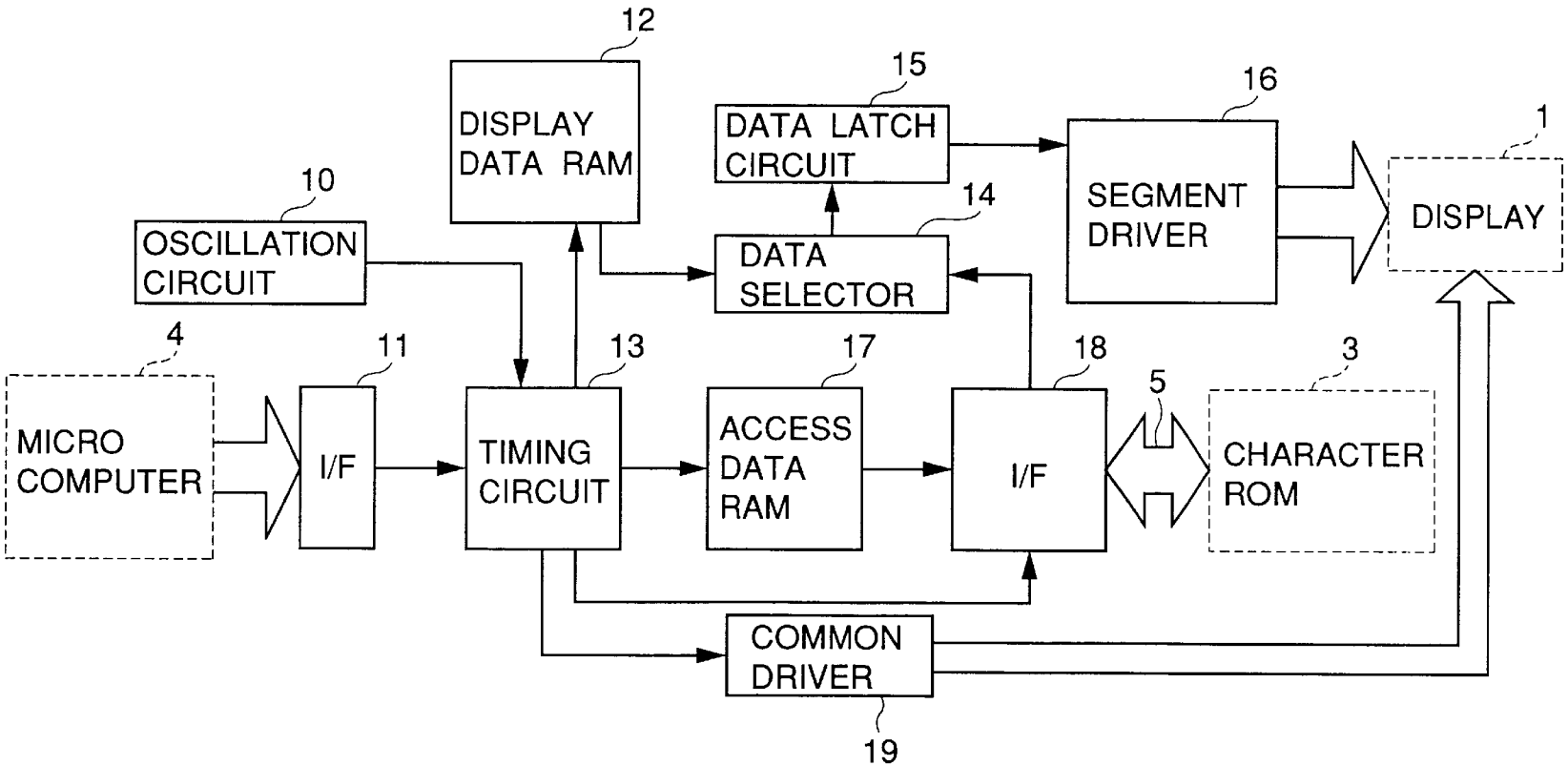
FIG. 4 is a block diagram of the internal configuration of the driver IC used in the first embodiment.

FIG. 4 shows the internal configuration of the driver IC 2. The data transmitted from the microcomputer 4 is fed to an interface (I/F) 11 and then to a timing circuit 13. The timing circuit 13 produces timing signals from the oscillated signal received from an oscillation circuit 10, and feeds the produced timing signals to a common driver 19, a display data RAM 12, an access data RAM 17, and an interface (I/F) 18. By being fed with the timing signal, the common driver 19 operates with a predetermined frame period. On receiving the above-mentioned designating signal from the microcomputer 4, the driver IC 2 stores it in the area memory (not shown) provided within itself; at this time, the driver IC 2 receives from the microcomputer 4 data that specifies the addresses of the areas (see FIG. 3).

In addition to producing the above-mentioned timing signals, the timing circuit 13, in accordance with the designating signal stored in the area memory, feeds the data received from the microcomputer 4 either to the access data RAM 17, when character-based display is requested, or to the display data RAM 12, when graphic display is requested.

The interface 18 feeds the address data received from the access data RAM 17 to the character ROM 3, and thereby allows the driver IC 2 to receive in response the display data (character data) of the corresponding characters from the character ROM 3. In accordance with the designating signal stored in the area memory (not shown), a data selector 14 feeds, for each of the areas (FIG. 3) on the display screen, the bit-mapped data stored in the display data RAM 12, when graphic display is requested in that area, or the character data read from the character ROM 3 by the interface 18 to a data latch circuit 15, when character-based display is requested in that area.

In accordance with the data latched in the data latch circuit 15, the segment driver 16 produces a driving signal and feeds it to the display 1. The display 1 achieves screen display in accordance with the driving signals it receives from the segment driver 16 and from the common driver 19.

As described above, in a display apparatus employing the driver IC 2 of the embodiment under discussion, to display characters such as symbols and letters stored in the character ROM 3, the microcomputer 4 has only to output address data with which to specify the characters to be displayed. Thus, the microcomputer 4 has only to access the driver IC 2 less frequently. This helps reduce the total time in which the microcomputer 4 is kept in a busy (operating) state, and thereby reduce the electric power consumed by the microcomputer 4. Moreover, since in most cases the microcomputer 4 is not dedicated to display-related operations, it is also possible to enhance the efficiency of the other operations performed by the microcomputer 4. Moreover, it is also possible to reduce the operation frequency of the microcomputer 4, and thereby reduce the electric power consumed by it. In particular, with a large-size display 1, it is possible to reduce the electric power consumption impressively, because it is not necessary to operate the microcomputer 4 at a higher rate in accordance with the size of the display 1.

Furthermore, the driver IC 2 and the microcomputer 4 are designed to operate on separate clocks, and the bus 5 between the driver IC 2 and the character ROM 3 is so configured as to include parallel-type address and data buses. This helps permit both the driver IC 2 and the character ROM 3 to operate at lower operation frequencies than in cases where serial-type buses are used, and thereby reduce the electric power consumption.

Note that the timing circuit 13 operates on a separate clock from the microcomputer 4. This means that it is possible to set their operation frequencies individually. Thus, in cases where an increase in the electric current consumption as results from an increase in the operation frequency does not have a serious effect, it is also possible to perform communication serially.

Moreover, by appropriately controlling the data selector 14, the driver IC 2 can specify, for each of the areas on the display screen, whether the area is used for character-based display or for graphic display. This makes it possible to achieve versatile screen display by mixing character-based display and graphic display on the same screen.

Although this embodiment deals with a case where the display 1 is a liquid crystal display, the driving device for a display of this embodiment can be used to drive various types of display other than a liquid crystal display by modifying the segment driver 16 and the common driver 19 shown in FIG. 4 in accordance with the type of the display 1 actually used.

Second Embodiment

Figure 5:
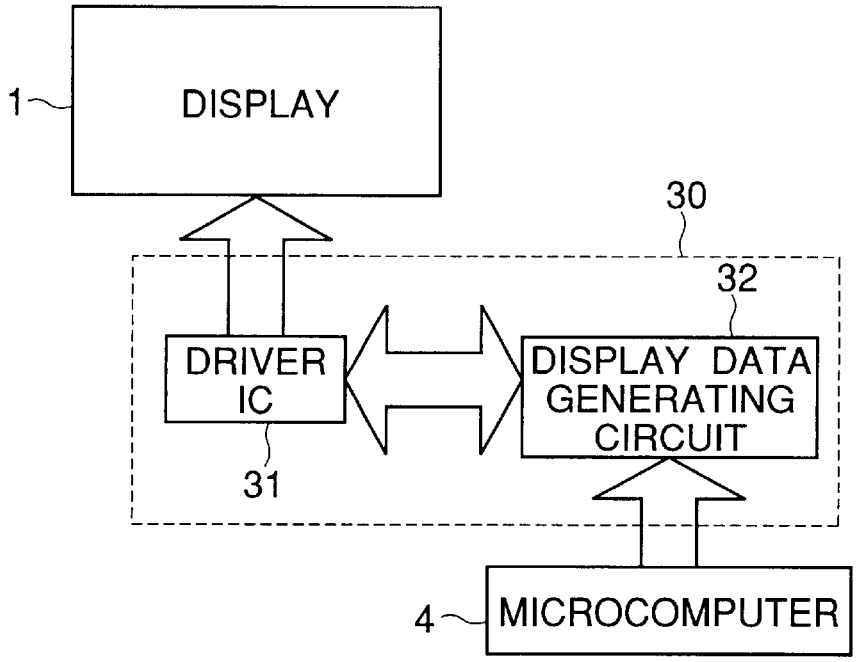
FIG. 5 is a block diagram of a driving device for a display of a second embodiment of the invention.

Next, a second embodiment of the present invention will be described. FIG. 5 shows a block diagram of a display apparatus employing the driving circuit 30 for a display of the second embodiment of the invention. The display apparatus is composed of a display 1 on which screen display is achieved, a driving circuit 30 that feeds the display 1 with a driving signal, and a microcomputer 4 that controls the screen display.

Figure 7:
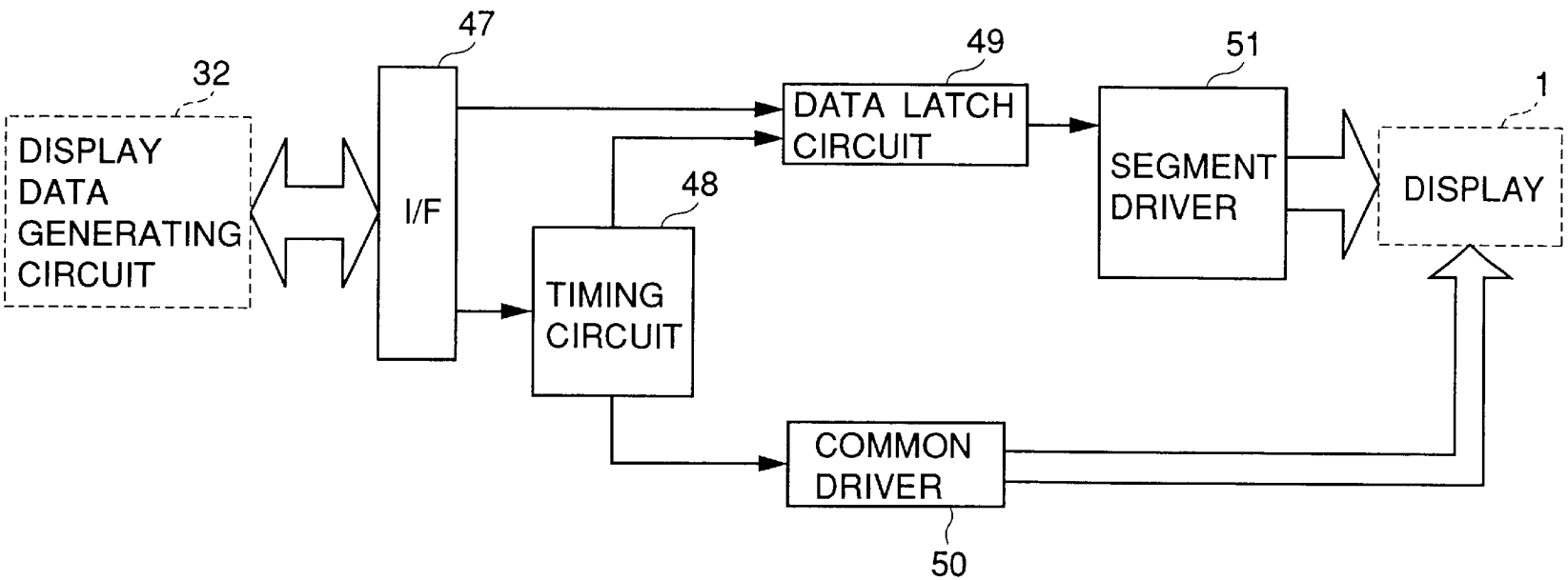
FIG. 7 is a block diagram of the internal configuration of the driver IC used in the second embodiment.

The driving circuit 30 is composed of a driver IC 31 and a display data generating circuit 32. In this embodiment, the driver IC 31 produces the driving signal in accordance with the display data it receives from the display data generating circuit 32. FIG. 7 shows the detailed configuration of the driver IC 31.

As in the first embodiment described previously, the microcomputer 4 feeds the driving circuit 30 with a designating signal that designates, for each of the areas (see FIG. 3) obtained by dividing the display screen of the display 1 in a lattice-like pattern, whether the area is used for graphic display or for character-based display.

The designating signal and the data transmitted from the microcomputer 4 are fed to the display data generating circuit 32. On receiving, for example, address data from the microcomputer 4, the display data generating circuit 32 reads from a character ROM 45 (see FIG. 6) provided within itself the display data of the characters such as symbols and letters to be displayed, and feeds the display data thus read to the driver IC 31. Then, in accordance with this display data, the driver IC 31 produces a driving signal, and feeds the produced signal to the display 1.

Figure 6:
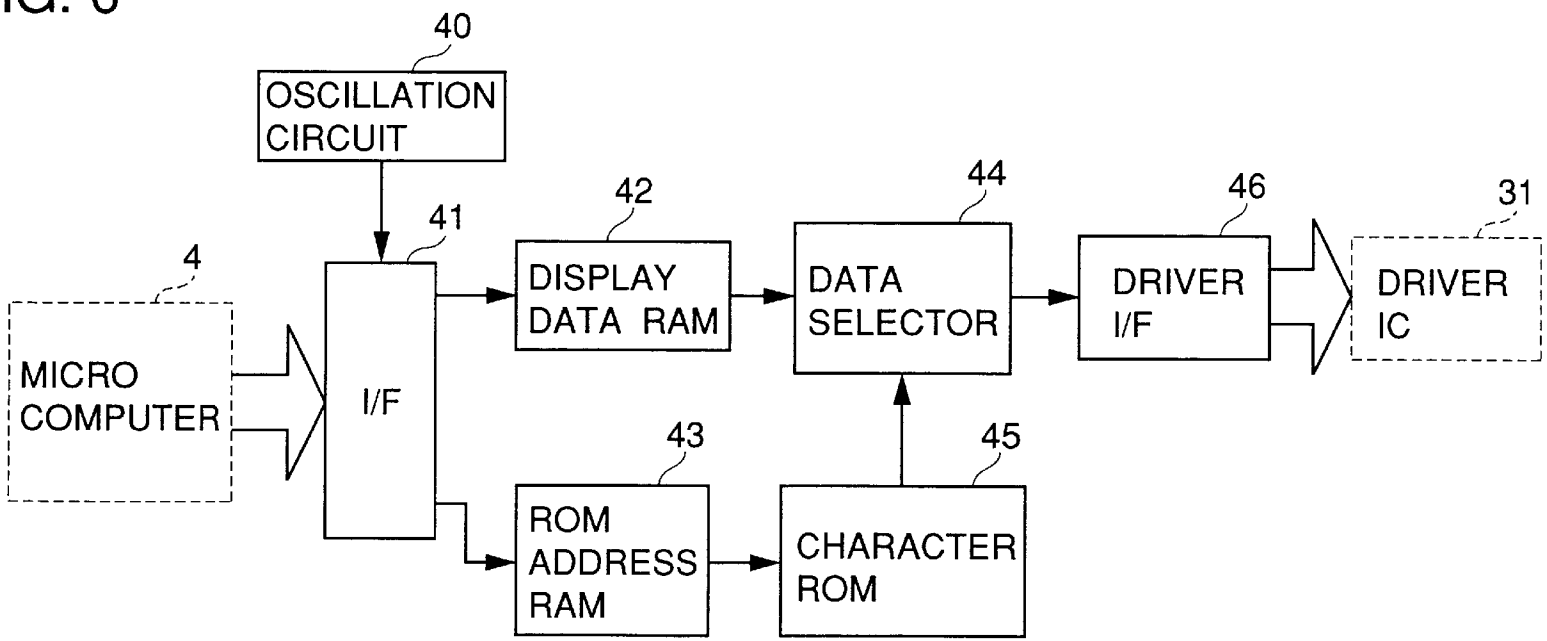
FIG. 6 is a block diagram of the internal configuration of the display data generating circuit used in the second embodiment.

FIG. 6 shows the internal configuration of the display data generating circuit 32. The data and signal transmitted from the microcomputer 4 are fed to an interface (I/F) 41. On receiving the designating signal, which designates the use of each of the above-mentioned areas, from the microcomputer 4, the interface 41 stores it in an area memory (not shown) provided within the display data generating circuit 32.

Then, in accordance with the designating signal stored in the above-mentioned area memory, the interface 41, if it receives display data from the microcomputer 4, stores the received display data in a display RAM 42, and, if it receives address data for the character ROM 45 from the microcomputer 4, stores the received address data in a ROM address RAM 43. The interface 41 also receives from an oscillation circuit 40 an oscillated signal, with which it controls the timing of data input and output.

The address data stored in the ROM address RAM 43 is fed to the character ROM 45, so that the character data specified by that address data is obtained from the character ROM 45. In accordance with the designating signal stored in the above-mentioned area memory, a data selector 44 checks, for each of the areas on the screen of the display 1, whether the area is used for graphic display or for character-based display so that, for an area used for graphic display, the display data stored in the display data RAM 42 is fed to a diver interface (I/F) 46, and, for an area used for character-based display, the character data obtained from the character ROM 45 is fed to the driver interface 46. The driver interface 46 feeds the data it receives from the data selector 44 to the driver IC 31. Note that the character ROM 45 stores, for example, Chinese/Japanese characters (two-byte characters) in the format as shown in FIG. 2, i.e. in the same format as the character ROM 3 (see FIG. 1) of the first embodiment described previously.

FIG. 7 shows the internal configuration of the driver IC 31. The display data fed from the display data generating circuit 32 enters the driver IC 31 through an interface 47. In accordance with the signal fed to the interface 47, a timing circuit 48 produces a clock having predetermined frame period and other characteristics, and feeds the produced clock to a data latch circuit 49 and to a common driver 50. The display data fed to the interface 47 is latched in the data latch circuit 49.

Then, in accordance with the display data latched in the data latch circuit 49, a segment driver 51 produces a driving signal. Eventually, the display 1 receives driving signals from the common driver 51 and the segment driver 50. As a result, on the display 1, screen display is achieved under the control of the microcomputer 4 in the same manner as in the first embodiment described previously, with graphic display and character-based display mixed on the same display screen.

As described above, also in this embodiment, to display characters, the microcomputer 4 has only to output the address data with which to specify the characters to be displayed. Thus, it is possible to allow the microcomputer 4 to access the driving circuit 30 less frequently, and thereby reduce the operation frequency of the microcomputer 4. Moreover, it is also possible to reduce the total time in which the microcomputer 4 is kept in a busy (operating) state. This makes it possible to reduce the electric power consumed by the microcomputer 4 and simultaneously enhance the efficiency of the operations other than the display-related ones performed by the microcomputer 4.

Third Embodiment

Figure 8:
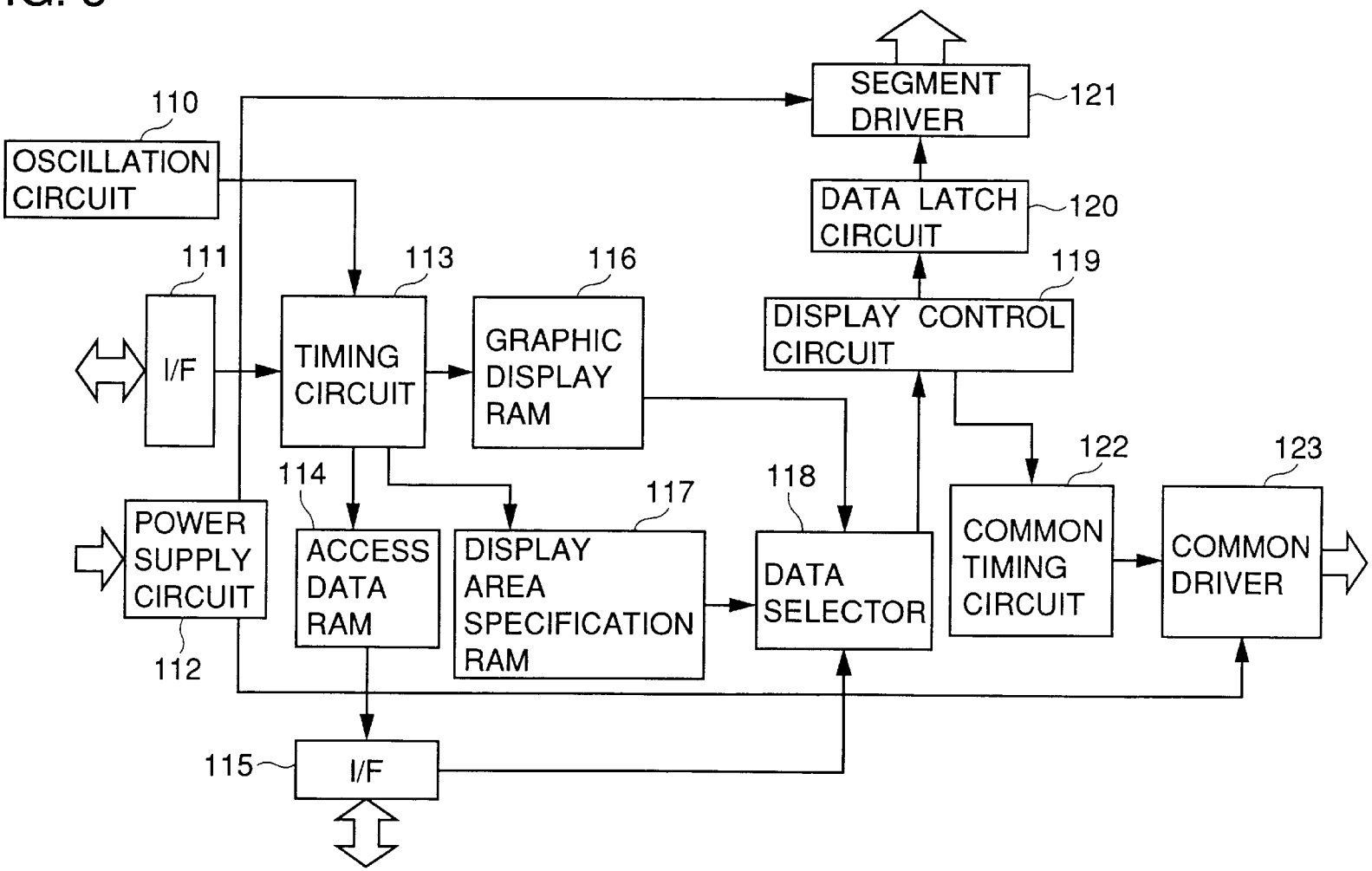
FIG. 8 is a block diagram of the internal configuration of the driver IC used in a third embodiment of the invention.

Next, a third embodiment of the present invention will be described with reference to FIGS. 8 to 10. The block diagram shown in FIG. 1 applies also to this embodiment. However, in this embodiment, the driver IC 2 has a configuration as shown in FIG. 8, rather than the configuration shown in FIG. 4. The display 1 is the same as in FIG. 1, and its display screen is divided into a total of 64 areas arranged in a lattice-like pattern as shown in FIG. 3. Each of those areas can be used to display a one-byte character.

The driver IC 2 assigns an address to each area, and stores the designating signal address by address in a display area specification RAM 117 (see FIG. 8) provided within itself. For example, the designating signal is equal to 0 (zero) when designating a graphic display area and equal to 1 (one) when designating a character-based display area.

FIG. 8 shows the internal configuration of the driver IC 2 of this embodiment. The data and the like transmitted from the microcomputer 4 (see FIG. 1) are fed to an interface (I/F) 111 and then to a timing circuit 113. The timing circuit 113 produces a timing signal having a predetermined period from the oscillated signal it receives from an oscillation circuit 110. The timing signal causes the driver IC 2 to operate at a predetermined operation frequency. On receiving the above-mentioned designating signal from the microcomputer 4, the driver IC 2 stores it in the display area specification RAM 117.

The microcomputer 4 feeds the driver IC 2 with the addresses with which to specify the areas (see FIG. 3) together with the display data for those addresses. For an area for graphic display, the timing circuit 113 receives bit-mapped data, and feeds the received bit-mapped data to a graphic display RAM 116.

On the other hand, for an area for character-based display, the timing circuit 113 receives the address data corresponding to the characters to be displayed, and feeds the received address data to an access data RAM 114. In this way, the timing circuit 113 serves not only to produce the above-mentioned timing signal, but also as a separating means for storing the data received from the microcomputer 4 either in the access data RAM 114 or in the graphic display RAM 116 depending on whether graphic or character-based display is requested.

The graphic display RAM 116 is a display data memory that stores bit-mapped data for graphic display. The address data fed from the access data RAM 114 is fed out of the driver IC 2 through an interface (I/F) 115, and in response the driver IC 2 receives from the character ROM 3 the display data for the characters to be displayed.

In accordance with the designating signal stored in the display area specification RAM 117, for each of the areas (see FIG. 3) on the display screen, a data selector 118 feeds the display control circuit 119 with, for an area for graphic display, the bit-mapped data stored in the graphic display RAM 116, and, for an area for character-based display, the character data read in through the interface 115.

A display control circuit 119 serves as a display control means that performs predetermined processing on the data fed from the data selector 118 in accordance with the control signal fed from the microcomputer 4. For example, the display control circuit 119 performs processing necessary to achieve scrolling of the characters displayed by character-based display, to achieve blinking of the displayed characters, to obtain gradation in the displayed image, and to achieve reversing of the displayed image (i.e. reversing of the image color and the background color). What processing to perform is specified by the control signal fed from the microcomputer 4.

In the display area specification RAM 117 is stored the designating signal that designates whether each of the areas is used for graphic or character-based display. In accordance with this designation signal, the display control circuit 119 recognizes the data fed from the data selector 118 as either data for graphic display or data for character-based display. Thus, the display control circuit 119 can perform processing that is valid either for character-based display only or for graphic display only.

The data processed by the display control circuit 119 to achieve scrolling or other is then latched in the data latch circuit 120. A segment driver 121 produces, from the source voltage supplied from a power supply circuit 112, a driving signal in accordance with the data latched in the data latch circuit 120. The power supply circuit 112 is turned on and off under the control of the microcomputer 4. This makes it possible to turn off the power source circuit 112 whenever no display is given on the screen, and thereby reduce the electric power consumed by the display apparatus.

A common timing circuit 122 feeds a timing signal to a common driver 123. The common timing circuit 122 operates under the control of the display control circuit 119. The common driver 123 produces, from the source voltage supplied from the power source circuit 112, a driving signal having a predetermined period. The driving signals produced by the segment driver 121 and the common driver 123 are fed to the display 1. In this way, screen display is achieved on the display 1.

An example of the processing performed by the display control circuit 119 will be described with reference to FIGS. 9 and 10. In FIG. 9, of the entire display screen, the four leftmost columns are used as an area 130 for character-based display, and the remaining areas are used as an area 131 for graphic display. Here, although only four one-byte characters "ABCD" are visible on the first line, it is to be assumed that the microcomputer 4 is now feeding the driver IC 2 with address data that specifies a string of one-byte characters "ABCDEF . . . "

Similarly, although only two two-byte characters "αβ" are visible on the second line, it is to be assumed that the microcomputer 4 is now feeding the driver IC 2 with address data that specifies a string of two-byte characters "αβγδεζ . . . " Similarly, although only four one-byte characters "0123" are visible on the fourth line, it is to be assumed that the microcomputer 4 is now feeding the driver IC 2 with address data that specifies a string of one-byte characters "012345 . . . " In the area 131, graphic display is achieved in accordance with the bit-mapped data fed from the microcomputer 4.

Now, suppose that the microcomputer 4 feeds the driver IC 2 with display control signals that request scrolling in the character-based display area and reversing in the graphic display area. Then, the driver IC 2 makes the display control circuit 119 perform the processing necessary to achieve scrolling and reversing, and, as a result, the display screen now looks as shown in FIG. 10.

In the area 130 for character-based display, scrolling is achieved in such a way that "BCDE" now appear on the first line, "βγ" on the second line, and "1234" on the fourth line. As described above, although only four columns are allotted to the character-based display area 130 on the screen (FIG. 9) before scrolling, the address data for "ABCDEF . . . " is already stored in the driver IC 2. Therefore, simply by making the microcomputer 4 feed the driver IC 2 with a display control signal that requests scrolling in the character-based display area alone, it is possible to display the four characters "BCDE", which includes the character "E" that was not displayed before scrolling. On the second line, scrolling is achieved one two-byte character at a time, so that the two characters "βγ" now appear. On the fourth line, the four characters "1234" now appear.

When the microcomputer 4 feeds the driver IC 2 with a display control signal that requests reversing, the bit-mapped data stored in the graphic display RAM 116 is fed through the data selector 118 to the display control circuit 119, which subjects the received bit-mapped data to the processing necessary to achieve reversing and then feeds the processed bit-mapped data to the data latch circuit 120. As a result, reversing is achieved in the graphic display area 131 as shown in FIG. 10. In this case, the color of the characters "ABCD" and the color of their background are reversed.

Figure 9:
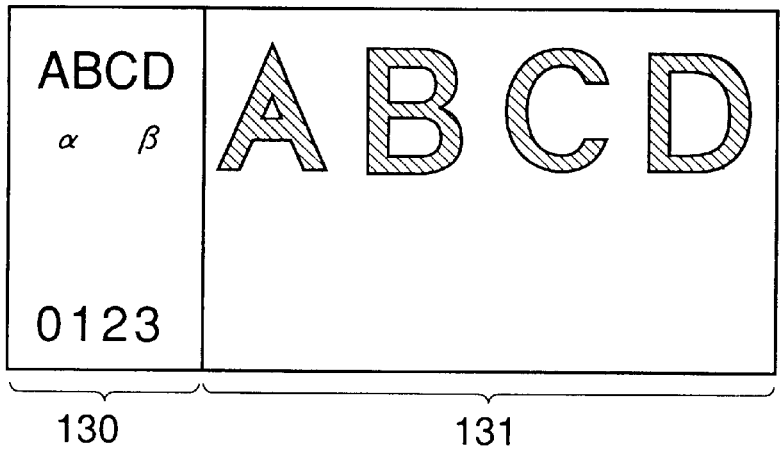
FIG. 9 is a diagram illustrating an example of screen display obtained on the display used in the third embodiment.
Figure 10:
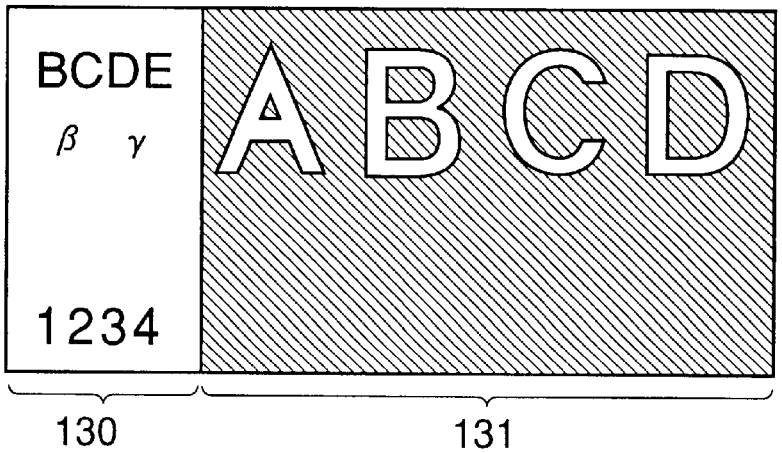
FIG. 10 is a diagram illustrating an example of screen display obtained after scrolling and reversing.

Thus, to change the state of the display screen from a state as shown in FIG. 9 to a state as shown in FIG. 10, the microcomputer 4 has only to feed the driver IC 2 with display control signals that request scrolling in the character-based display area 130 and reversing in the graphic display area 131.

By contrast, in the conventional display apparatus (FIG. 11) described earlier, the microcomputer 62 needs to read the characters to be displayed from the character ROM 63 so that the bit-mapped data reflecting the state of the screen after scrolling is fed to the driver IC 61. By contrast, in the embodiment under discussion, the microcomputer 4 has only to feed the driver IC 2 with a screen control signal. This helps reduce the operations that the microcomputer 4 needs to perform, and also helps permit the microcomputer 4 to access the driver IC 2 far less frequently.

Moreover, in this embodiment, the driver IC 2 reads the display data of the characters to be displayed from the character ROM 3 and stores the obtained display data within itself. Therefore, to display characters, the microcomputer 4 does not need to access the character ROM 3, and has only to feed the driver IC 2 with the address data corresponding to those characters. This helps permit the microcomputer 4 to access the driver IC 2 less frequently.

Although scrolling is achieved only in the character-based display area in the example shown in FIGS. 9 and 10, it is also possible to leave the character-based display area intact and perform scrolling only in the graphic display area. In this way, it is possible to achieve versatile screen display by mixing character-based display and graphic display on the same screen. Moreover, in this embodiment, the graphic display RAM 116 is given a storage capacity for two screenfuls of display data. This makes it possible to change the graphic screen simply by switching from one set of display data to the other.

What is claimed is:

1. A driving device for a display, comprising;

a driver for forming a signal with which to drive a display in accordance with display data;

a character ROM having bit-mapped character data stored therein and for outputting the character data to the driver in accordance with a specified address;

designating means for producing a designating signal by which each of display areas obtained by dividing a display screen of the display is designated as either a character-based display area or a graphic display area;

input means for accepting input of graphic data and address data of the character ROM;

a first RAM for storing the address data of the character ROM;

a second RAM for storing the graphic data;

separating means for feeding, in accordance with the designating signal, the address data of the character ROM to the first RAM for the display areas designated as character-based display areas and the graphic data to the second RAM for the display areas designated as graphic display areas; and a selector for feeding either the bit-mapped character data from the character ROM or the graphic data from the second RAM to each of the display areas in accordance with whether the display area is designated as a character-based display area or a graphic display area.

2. A driving device for a display as claimed in claim 1, wherein the designating signal, the graphic data, and the address data are fed from a microcomputer.

3. A driving device for a display as claimed in claim 1, wherein the graphic data is stored in the second RAM as bit-mapped data.

4. A driving device for a display as claimed in claim 1, wherein the display is a liquid crystal display, and an output of the selector is fed to the display through a segment driver.

5. A driving device for a display as claimed in claim 1, further comprising:

a display control circuit for achieving a change in what is displayed on the display, wherein an output of the selector is fed to the display control circuit so as to be first subjected to predetermined processing performed to achieve a change in what is displayed on the display and then fed to the driver.

6. A driving device for a display as claimed in claim 5, wherein the predetermined processing is performed to achieve scrolling of what is displayed on the display.

7. A driving device for a display as claimed in claim 5, wherein the predetermined processing is performed to achieve blinking of what is displayed on the display.

8. A driving device for a display as claimed in claim 5, wherein the predetermined processing is performed to achieve reversing of an image color and a background color in what is displayed on the display.

9. A driving device for a display, comprising:

a driver integrated circuit device for feeding a driving signal to a display;

a read-only memory having bit-mapped characters stored therein; and a microcomputer for feeding the driver integrated circuit device with bit-mapped data used to achieve graphic display, address data used to specify characters, and a designating signal by which each of display areas obtained by dividing a display screen of the display is designated as either a character-based display area or a graphic display area;

wherein the driver integrated circuit device, on receiving bit-mapped data used to achieve graphic display from the microcomputer, produces a driving signal in accordance with the received bit-mapped data, and, on receiving address data from the microcomputer, reads bit-mapped characters from the read-only memory at addresses specified by the received address data and produces a driving signal for character-based display, and the bit-mapped characters read from the read-only memory are transferred without involving the microcomputer.

10. A driving device for a display as claimed in claim 9, wherein the driver integrated circuit device includes:

a driver circuit whose output is coupled to the display; and a display control circuit for achieving a change in what is displayed on the display by performing predetermined processing on data that is fed to the driver circuit.

11. A driving device for a display as claimed in claim 10, wherein the predetermined processing is performed to achieve scrolling of what is displayed on the display.

12. A driving device for a display as claimed in claim 10, wherein the predetermined processing is performed to achieve blinking of what is displayed on the display.

13. A driving device for a display as claimed in claim 10, wherein the predetermined processing is performed to achieve reversing of an image color and a background color in what is displayed on the display.

14. A driving device for a display as claimed in claim 10, wherein the predetermined processing is performed to obtain gradation in what is displayed on the display.

15. A driving device for a display, comprising:

a timing circuit for separating input data in accordance with a type thereof, the input data including bit-mapped data used to achieve graphic display, address data used to read externally provided bit-mapped character data, and a designating signal by which each of display areas obtained by dividing a display screen is designated as either a character-based display area or a graphic display area;

a memory for storing the input data that is outputted from the timing circuit;

a driver circuit for producing a drive signal with which to drive a display in accordance with the bit-mapped data used to achieve graphic display and the character data;

a control signal feeding circuit for feeding a control signal;

a memory for storing the bit-mapped character data;

a reading circuit for reading bit-mapped character data corresponding to characters to be displayed in accordance with the address data and feeding the data thus read to the driver circuit; and a display control circuit for achieving a change, in accordance with the control signal, in what is displayed on the display by performing predetermined processing on data that is fed to the driver circuit.

16. A driving device for a display as claimed in claim 15, wherein the predetermined processing is performed to achieve scrolling of what is displayed on the display.

17. A driving device for a display as claimed in claim 15, wherein the predetermined processing is performed to achieve blinking of what is displayed on the display.

18. A driving device for a display as claimed in claim 15, wherein the predetermined processing is performed to achieve reversing of an image color and a back[]ground color in what is displayed on the display.

19. A driving device for a display as claimed in claim 15, wherein the predetermined processing is performed to obtain gradation in what is displayed on the display.

* * * * *